US006401697B1

(12) United States Patent
Banzhaf

(10) Patent No.: US 6,401,697 B1
(45) Date of Patent: Jun. 11, 2002

(54) SOLENOID VALVE FOR REGULATING THE FUEL SUPPLY PRESSURE OF AN INTERNAL COMBUSTION ENGINE

(75) Inventor: Werner Banzhaf, Sindelfingen (DE)

(73) Assignee: Elasis Sistema Ricerca Fiat Nel Mezzogiorno, Pomigliano D'Arco (IT)

( * ) Notice: Subject to any disclaimer, the term of this patent is extended or adjusted under 35 U.S.C. 154(b) by 0 days.

(21) Appl. No.: 09/666,822

(22) Filed: Sep. 21, 2000

(30) Foreign Application Priority Data

Sep. 21, 1999 (IT) ..... TO9900174 U

(51) Int. Cl.[7] ..... F02M 37/04
(52) U.S. Cl. ..... 123/510; 137/550
(58) Field of Search ..... 123/510, 511, 123/457, 458; 137/550; 251/129.14, 129.15

(56) References Cited

U.S. PATENT DOCUMENTS 5,174,336 A * 12/1992 Casey et al. ..... 251/129.15
5,533,478 A * 7/1996 Robinson ..... 123/510
5,836,350 A * 11/1998 Sakaguchi et al. ..... 137/550
6,098,652 A * 8/2000 Brandt ..... 137/315.05
6,131,608 A * 10/2000 Lu ..... 137/550
6,189,985 B1 * 2/2001 Fritsch et al. ..... 251/129.02
6,254,199 B1 * 7/2001 Megerle et al. ..... 137/550

* cited by examiner

*Primary Examiner*—Thomas N. Moulis
(74) *Attorney, Agent, or Firm*—Merchant & Gould PC

(57) ABSTRACT

The solenoid valve has a fuel feed conduit, and a shutter in the form of a ball controlled by an electromagnet and cooperating with a conical seat in the conduit. The conduit has a fuel filter for preventing particles of dirt from getting between the seat and the shutter, without causing an excessive fall in fuel pressure. The filter is defined by a metal plate having a number of holes of about 0.1 mm in diameter and formed using laser technology; and the plate is fitted to the opposite end of the conduit from the seat.

5 Claims, 1 Drawing Sheet

SOLENOID VALVE FOR REGULATING THE FUEL SUPPLY PRESSURE OF AN INTERNAL COMBUSTION ENGINE

The present invention relates to an improved solenoid valve for regulating the fuel supply pressure of an internal combustion engine.

BACKGROUND OF THE INVENTION

In modern engine fuel supply systems, a high-pressure pump supplies the fuel to a distributor or so-called "common rail" which supplies the various engine cylinder injectors; and the fuel pressure in the distributor is normally controlled and maintained constant by means of a solenoid valve controlled by a pressure sensor to drain any surplus fuel supplied by the high-pressure pump back into the tank. The solenoid valve comprises a feed conduit communicating with the delivery conduit of the high-pressure pump; and a shutter controlled by an electromagnet and cooperating with a seat in the feed conduit.

In one known pressure regulating solenoid valve incorporated in a radial-piston pump, the shutter is defined by a ball controlled by the end of a stem on the electromagnet armature, and which cooperates with a conical sealing seat at one end of the feed conduit.

On account of dirt, e.g. metal particles, between the ball and the conical sealing seat, the above solenoid valve is subject to sealing problems resulting in a fall in pressure and, hence, malfunctioning of the supply system. And, on account of the very high operating pressure involved, e.g. around 1400 bar, ordinary filtration means inserted inside the feed conduit also result in a fall in pressure in the feed conduit.

SUMMARY OF THE INVENTION

It is an object of the present invention to provide an extremely straightforward, reliable pressure regulating solenoid valve designed to eliminate the aforementioned drawbacks typically associated with known solenoid valves.

According to the present invention, there is provided a solenoid valve comprising a fuel feed conduit, and a shutter controlled by an electromagnet and cooperating with a seat located in said conduit; and characterized by comprising fuel filtering means housed in said conduit to prevent particles of dirt from getting between said seat and said shutter, with no excessive reduction in fuel pressure.

In particular, in a solenoid valve in which the seat is conical and located at one end of said conduit, and the shutter comprises a ball cooperating with said conical seat, the filtering means comprise a metal plate having a number of holes and fixed to another end of the feed conduit.

BRIEF DESCRIPTION OF THE DRAWINGS

A preferred, non-limiting embodiment of the invention will be described by way of example with reference to the accompanying drawings, in which.

DETAILED DESCRIPTION OF THE INVENTION

Figure 1:
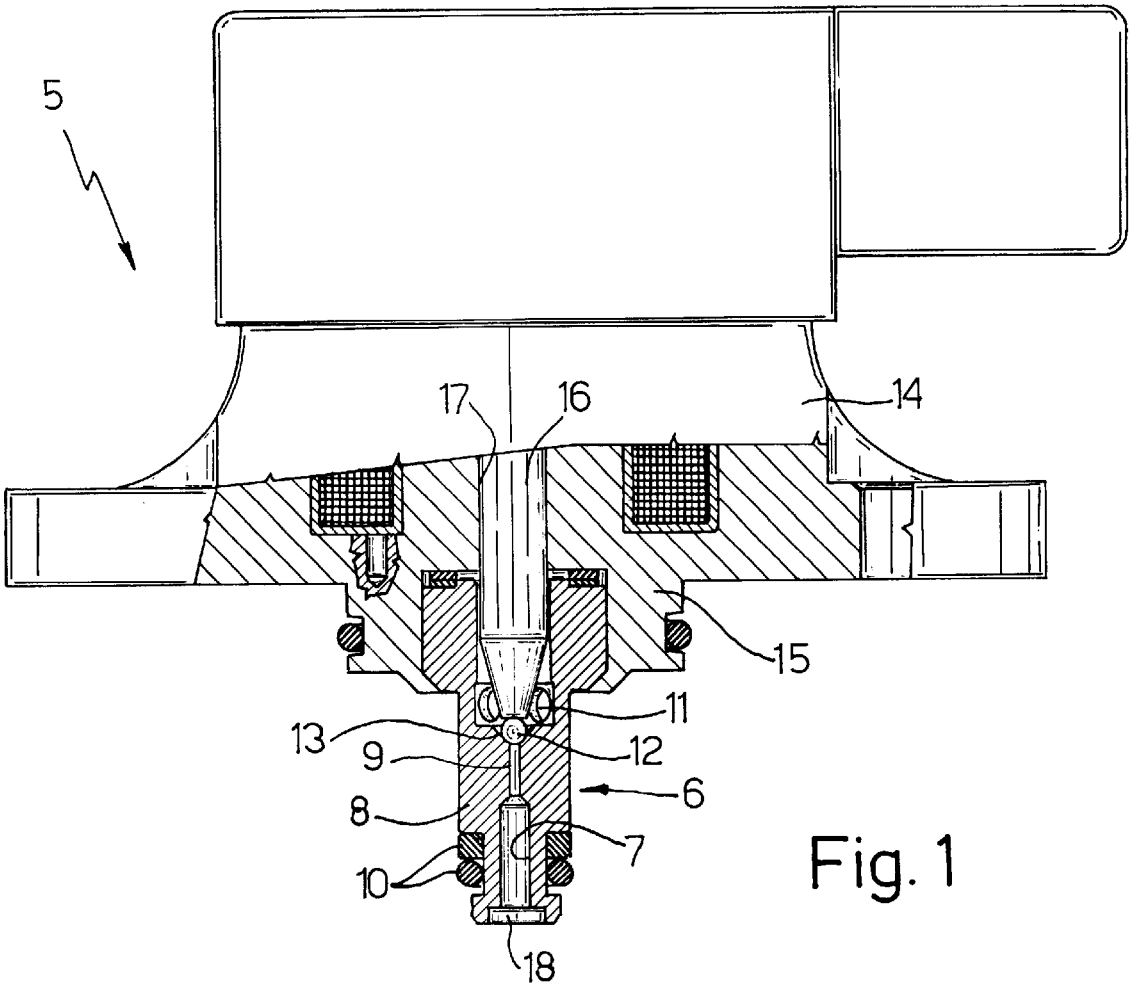
FIG. 1 shows a partially sectioned view of a fuel pressure regulating solenoid valve in accordance with the present invention.

Number 5 in FIG. 1 indicates as a whole a solenoid valve for regulating the fuel supply pressure of an internal combustion engine. Solenoid valve 5 comprises a valve body 6 having a feed conduit 7 extending axially inside a first cylindrical portion 8 of valve body 6; feed conduit 7 comprises a calibrated-diameter portion 9 and communicates with the delivery side of a high-pressure fuel supply pump not shown; and cylindrical portion 8 is fitted in fluidtight manner to the body of the pump by means of appropriate seals 10.

Cylindrical portion 8 has a number of radial holes 11 communicating with a discharge conduit (not shown) in the pump body; a shutter in the form of a ball 12 is located between feed conduit 7 and radial holes 11, and engages a conical seat 13, formed on the end of portion 9, to close conduit 7; solenoid valve 5 comprises an electromagnet 14 having a body 15 to which valve body 6 is fitted in known manner; and electromagnet 14 controls an armature having a stem 16 sliding inside a hole 17 in body 15 and controlling ball 12.

The fuel pressure in feed conduit 7 must be kept at an operating pressure of at least 1000 bar; the operating pressure preferably selected is about 1400 bar; and the inside diameter of conduit 7 may advantageously be about 2.5 mm.

Figure 2:
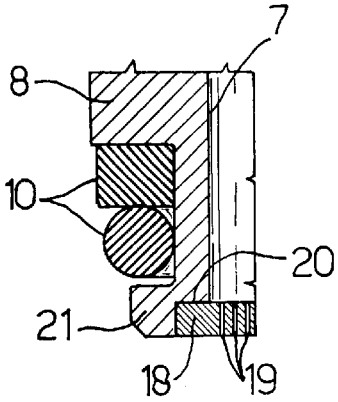
FIG. 2 shows a larger-scale detail of FIG. 1.

According to the invention, feed conduit 7 is provided with fuel filtering means, i.e. a filter comprising a metal plate 18 having a number of holes 19 (FIG. 2); and plate 18 is inserted and fixed in known manner inside a seat defined by a shoulder 20 at the end 21 of conduit 7 opposite conical seat 13.

Perforated plate 18 Prevents particles of dirt—normally small particles of metal—from getting between conical seat 13 and ball 12, and so safeguards solenoid valve 5 against sealing problems which may lower the fuel pressure in conduit 7 to the extent of impairing operation of the fuel supply system. At the same time, however, perforated plate 18 must be such as not to produce an excessive fall in fuel pressure in conduit 7, and to prevent hydraulic cavitation erosion phenomena.

For which purpose, plate 18 must comprise at least 200 holes, and each hole 19 must be less than 0.25 mm in diameter. Preferably, plate 18 may be made of high tensile steel, and may be about 1 mm thick. Holes 19 may be about 0.1 mm in diameter and about 500 in number; and such a number of very small diameter holes 19 may be formed using a known laser drilling device.

In perforated plate 18, the ratio between the length of holes 19 and the total passage section is such as to prevent an excessive fall in pressure, and the ratio between the total passage section of holes 19 and the passage section between ball 12 and conical seat 13 of solenoid valve 5 is such as to prevent constriction along the fuel conduit.

The advantages, with respect to known solenoid valves, of solenoid valve 5 according to the invention will be clear from the foregoing description. That is, filter 18, 19 in feed conduit 7, on the one hand, ensures efficient sealing of ball 12 inside conical seat 13 with no excessive loss in pressure, and, on the other, prevents cavitation erosion phenomena in conical seat 13.

Clearly, changes may be made to the solenoid valve as described herein without, however, departing from the scope of the accompanying claims. For example, the filter may be a different type, may comprise more than one perforated plate, and may be located anywhere along conduit 7.

What is claimed is:

1. A solenoid valve for regulating the fuel supply pressure of an internal combustion engine, comprising an electromagnet a valve body fitted to a body of said electromagnet, said valve body having a cylindrical portion provided with a feed conduit adapted to be fed with fuel at a pressure of at least 1000 bar, said cylindrical portion defining radial holes communicating with a discharge conduit, said feed conduit extending anally inside said cylindrical portion and including at one end a calibrated-diameter portion terminating with a valve conical seat, a ball shutter housed between said radial holes and said valve conical seat, said ball shutter cooperating with a stem of an armature controlled by said electromagnet, said feed conduit being fitted at another end with a filtering metal plate to prevent particles of dirt from getting between said seat and said shutter, with no excessive reduction in fuel pressure, said metal plate being about 1 mm thick and defining at least 200 holes, wherein each of the at least 200 holes is less than 0.25 mm in diameter.

2. A solenoid valve as claimed in claim 1, characterized in that said fuel pressure is about 1400 bar.

3. A solenoid valve as claimed in claim 1, characterized in that said plate (18) is housed inside a seat defined by a shoulder (20) at said other end (21).

4. A solenoid valve as claimed in claim 1, characterized in that said conduit (7) has an inside diameter of about 2.5 mm; and in that said plate (18) comprises about 500 holes (19); each of said holes (19) being about 0.1 mm in diameter.

5. A solenoid valve as claimed in claim 1, characterized in that said holes (19) are formed using a laser.

* * * * *

UNITED STATES PATENT AND TRADEMARK OFFICE

CERTIFICATE OF CORRECTION

PATENT NO. : 6,401,697 B1
DATED : June 11, 2002
INVENTOR(S) : Banzhaf

It is certified that error appears in the above-identified patent and that said Letters Patent is hereby corrected as shown below:

Title page,
Item [73], Assignee, "Elasis Sistema Ricerca Fiat Nel Mezzogiorno" should read -- Robert Bosch Gmbh --

Item [56], References Cited, U.S. PATENT DOCUMENTS, insert

-- 5,925,205 07/1999 Zimmermann et al. ……. 239/575 --

Insert -- FOREIGN PATENT DOCUMENTS

| | | |
|---|---|---|
| DE | 198 00 760 | 08/1998 |
| EP | 0 267 162 | 05/1998 |
| EP | 0 882 885 | 12/1998 |
| UK | 2 112 065 | 07/1983 -- |

Signed and Sealed this

Twenty-seventh Day of May, 2003

JAMES E. ROGAN
*Director of the United States Patent and Trademark Office*